US008852419B2

(12) United States Patent
Powell, IV et al.

(10) Patent No.: US 8,852,419 B2
(45) Date of Patent: Oct. 7, 2014

(54) METHOD AND APPARATUS FOR RECYCLING HIGH-VAPOR PRESSURE, LOW-ELECTRONEGATIVITY METALS

(75) Inventors: Adam C. Powell, IV, Newton, MA (US); Steve J. Derezinski, III, Wellesley, MA (US)

(73) Assignee: Infinium, Inc., Natick, MA (US)

( * ) Notice: Subject to any disclaimer, the term of this patent is extended or adjusted under 35 U.S.C. 154(b) by 490 days.

(21) Appl. No.: 12/896,143

(22) Filed: Oct. 1, 2010

(65) Prior Publication Data

US 2011/0079517 A1 Apr. 7, 2011

Related U.S. Application Data

(60) Provisional application No. 61/248,036, filed on Oct. 2, 2009.

(51) Int. Cl.
*C25C 3/04* (2006.01)
*C25C 3/00* (2006.01)

(52) U.S. Cl.
CPC .... *C25C 3/04* (2013.01); *C25C 3/00* (2013.01)
USPC ..... 205/404

(58) Field of Classification Search
CPC ..... C25C 3/02; C25C 3/04
USPC ..... 204/243.1–247.5; 205/353, 354–411
See application file for complete search history.

(56) References Cited

U.S. PATENT DOCUMENTS 4,183,745 A * 1/1980 Tsumura ..... 75/10.47
4,880,506 A * 11/1989 Ackerman et al. ..... 205/44
5,118,396 A * 6/1992 Claus et al. ..... 205/363
5,215,631 A * 6/1993 Westfall ..... 205/351
5,409,580 A * 4/1995 Gesing et al. ..... 205/363
5,427,657 A 6/1995 Sharma
5,439,563 A * 8/1995 Sivilotti ..... 205/404
5,665,220 A * 9/1997 Sharma ..... 205/359
5,853,560 A * 12/1998 Sharma ..... 205/405
5,972,200 A * 10/1999 Kim ..... 205/784.5
6,540,902 B1 * 4/2003 Redey et al. ..... 205/354
6,921,473 B2 * 7/2005 Ward-Close et al. ..... 205/363
7,252,751 B2 * 8/2007 Wang ..... 205/363

FOREIGN PATENT DOCUMENTS

WO WO-2007/011669 A2 1/2007
WO WO 2008/046018 * 4/2008 ..... C25C 3/04

OTHER PUBLICATIONS

Mishra et al. Molten salt applications in materials processing. 2005. Journal of Physics and Chemistry of Solids. 66.*

(Continued)

*Primary Examiner* — Nicholas A Smith
*Assistant Examiner* — Ciel Thomas
(74) *Attorney, Agent, or Firm* — Wilmer Cutler Pickering Hale and Dorr LLP

(57) ABSTRACT

Recycling methods and apparatus produce elements of high purity from diverse feedstock materials melted in an electronically conductive liquid. Distinct anodes are used in respective circuits configured for electrorefining and electrowinning. The electrorefining circuit is operable to produce an element in a gaseous state. The electrowinning circuit includes a SOM anode, allowing feedstock materials incorporating significant oxide constituents to be recycled. The methods and apparatus are suitable for magnesium recycling.

47 Claims, 4 Drawing Sheets

(56) References Cited

OTHER PUBLICATIONS

"Notification of Transmittal of the International Search Report and the Written Opinion of the International Searching Authority, or the Declaration," International Filing Date: Oct. 1, 2010, International Application No. PCT/US2010/002669, Applicant: Metal Oxygen Separation Technologies, Inc., Date of Mailing: Dec. 14, 2010, pp. 1-10.

* cited by examiner

METHOD AND APPARATUS FOR RECYCLING HIGH-VAPOR PRESSURE, LOW-ELECTRONEGATIVITY METALS

CROSS-REFERENCE TO RELATED APPLICATIONS

The present application claims the benefit of U.S. Provisional Patent Application Ser. No. 61/248,036, which was filed on Oct. 2, 2009, by Adam Powell, IV et al. for METHOD AND APPARATUS FOR CONTINUOUS EXTRACTION OF MAGNESIUM AND OTHER HIGH-VAPOR PRESSURE LOW-ELECTRONEGATIVITY METALS and is hereby incorporated by reference.

BACKGROUND OF THE INVENTION

1. Field of the Invention

This invention relates to systems for recycling or producing an element from feedstock material incorporating an oxide or alloy of the element. In particular this invention relates to apparatus and methods for producing high-purity magnesium from post-consumer scrap.

2. Background Information

Prompt and primary magnesium scrap are generally of a consistent chemistry with low oxide content, allowing them to be readily reused by die casting or strip casting. However, post-consumer magnesium scrap may include diverse alloy formulations and/or be highly oxidized, so that the magnesium is not recoverable in a useful form by such remelting-based methods, which are capable of diluting but not true refining. Thus, the presence of constituents deleterious to the mechanical properties of magnesium, for example, iron, nickel and chromium is not addressed by such treatments. Consequently, post-consumer magnesium scrap, such as the output from an automobile shredder, is not in general suitable for use in high-value products such as new automobiles after straightforward sorting and remelting.

Magnesium metal has a low density, with a high specific stiffness and specific strength. These attributes suit magnesium well for use in motor vehicles. U.S. automobile manufacturers project increasing in the average amount of magnesium used in cars and light trucks to 350 pounds per vehicle, compared to the current average of only about ten to fifteen pounds. Such expanded magnesium use, while desirable in some aspects, would likely create enormous landfill difficulties in the absence of a use for magnesium components at the end of a vehicle lifetime. There is, accordingly, a need for an economical and flexible approach to magnesium recycling.

SUMMARY OF THE INVENTION

In one embodiment, an apparatus for producing an element from a feedstock material including an oxide of the element and the element not bonded in the oxide comprises a liquid electrolyte; a cathode in electrical contact with the liquid electrolyte; an anode; an electronically conductive liquid incorporating the element, not bonded to oxygen, from melted feedstock material; and a current collector in electrical contact with the electronically conductive liquid. The electrolyte is capable of dissolving the oxide of the element. The anode is separated from the liquid electrolyte by a membrane capable of conducting oxygen anions from the electrolyte. The electronically conductive liquid may be in contact with the electrolyte at a horizontal interface and not in contact with either of the cathode and the membrane. The element may be magnesium and the oxide of the element may be magnesium oxide.

In another embodiment, an apparatus for producing an element from a feedstock material including the element not bonded in a compound, comprises a liquid electrolyte; a cathode; an electronically conductive liquid; a current collector in electrical contact with the electronically conductive liquid; and a power source configured to extract electrons from the current collector and provide electrons to the cathode. The electronically conductive material incorporates the element from melted feedstock material. The cathode is in contact with the electrolyte along a horizontal interface and not in contact with the cathode. The cathode is at a temperature such that the apparatus is operable to produce the element in a gaseous state at the cathode. The element may be magnesium.

In another embodiment, a method of producing an element from a feedstock material including an oxide of the element and the element not bonded in the oxide of the element comprises providing a liquid electrolyte capable of dissolving the oxide of the element; providing a cathode in electrical contact with the electrolyte; providing an anode; melting the feedstock material, the melted feedstock material being in an electronically conductive liquid; extracting electrons from the electronically conductive liquid; and providing electrons to the cathode, thereby forming the element at the cathode. The anode is separated from the electrolyte by a membrane capable of conducting oxygen anions. Extracting electrons from the electronically conductive liquid generates species bearing the element in an oxidized state in the electrolyte. The electronically conductive liquid is in contact with the electrolyte along a horizontal interface and not in contact with either of the cathode and the membrane. The element may be magnesium and the oxide of the element may be magnesium oxide.

In yet another embodiment, a method of producing an element from a feedstock material incorporating the element not bonded in a compound comprises providing a liquid electrolyte; providing a cathode in electrical contact with the electrolyte; melting the feedstock material, the melted feedstock material being in an electronically conductive liquid; extracting electrons from the electronically conductive liquid; and providing electrons to the cathode, thereby reducing species bearing the element in an oxidized state and forming the element in a gaseous phase at the cathode. The electronically conductive liquid is in contact with the electrolyte along a horizontal interface and not in contact with the cathode. Extracting electrons from the electronically conductive liquid generates species bearing the element in an oxidized state in the electrolyte. The element may be magnesium.

BRIEF DESCRIPTION OF THE DRAWINGS

The invention description below refers to the accompanying drawings, wherein identical reference symbols designate like structural or functional elements, and in which.

Features in the figures are not, in general, drawn to scale.

DETAILED DESCRIPTION OF AN ILLUSTRATIVE EMBODIMENT

Figure 1:
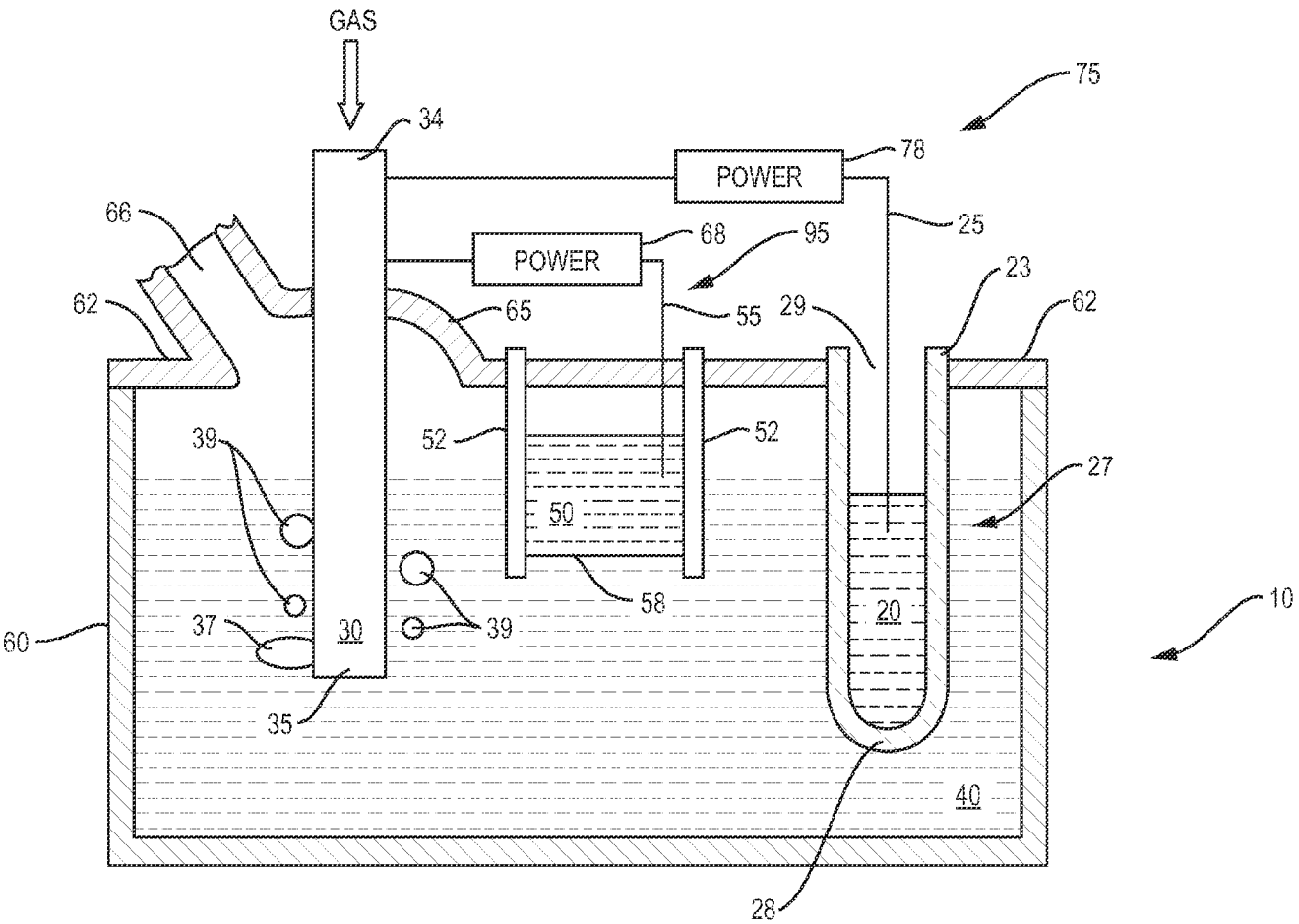
FIG. 1 is a schematic diagram of a floating-electrode recycling system compatible with the invention in which the vessel, scrap electrode and anode are shown in cross section.

With reference to FIG. 1, in an illustrative embodiment, an electrolytic recycling system 10 incorporates electrorefining and extraction features to enable recycling of an element of interest from a feedstock material which may include the element of interest in two distinct states of association or bonding: the oxide of the element; and the element not bonded in the oxide. The feedstock material may further incorporate one or more elements, such as metals, other than the element of interest. The system 10 described herein is adapted for recycling the exemplary element magnesium.

The system 10 includes an anode 20, a cathode 30 and an intervening liquid electrolyte 40, in electrical contact with the cathode 30, in which the oxide is dissolved. The anode 20 is separated from the electrolyte 40 by an ionically conductive membrane 23. The electrolyte 40 is contained by a housing including a vessel 60 covered by a lid 62.

An electronically conductive liquid body 50, also referred to herein as the scrap electrode, includes the element of interest in the vessel 60 and incorporates melted feedstock material. The body 50 meets the electrolyte 40 to form a substantially horizontal interface 58 across which matter may pass from the body 50 into the electrolyte 40. As used herein with reference to the interface 58, "substantially horizontal" means that the interface 58 is the junction between two vertically stacked layers 40 and 50, regardless of whether the interface 58 is altogether flat and perfectly level or is instead three-dimensional. A solid, electronically conductive current collector 55 in electrical contact with the body 50 feeds through the lid 62 to connect the liquid body 50 to an electrical circuit as described below.

The electrolyte 40, the cathode 30, a power supply 68 and the liquid body 50 form an electrorefining circuit 95. The power supply 68 of the electrorefining circuit 95 is configured to receive electrons from the liquid body 50 through the current collector 55 and to deliver electrons to the cathode 30 during operation of the system 10. The power supply 68 may be a DC voltage source operable to apply sufficient voltage across the liquid body 50 and the cathode 30 to effect transfer of the element of interest, magnesium in the present example, from the body 50 through the electrolyte 40 to the higher-activity environment of its elemental state in the product at the cathode 30. Illustratively the power supply 68 is configured to apply about 1.0 to 1.5 volts DC between the cathode 30 and the current collector 55 to concentrate magnesium and cover resistances and overpotentials in the elements of the circuit 95. Alternatively, the power supply 68 may be a DC current source operable to drive oxidation, transport, and reduction of magnesium at a desired rate.

The electrolyte 40, the cathode 30, a power supply 78 and the anode 20 form an electrowinning circuit 75. The power supply 78 of the electrowinning circuit 75 is configured to receive electrons from the anode 20 through a lead 25 and to deliver electrons to the cathode 30 during operation of the system 10. The power supply 78 may be a DC voltage source operable to apply sufficient voltage across the anode 20 and the cathode 30 to cause decomposition of the oxide of the element of interest, which is magnesium oxide (MgO) in the present example, in the electrolyte 40. Illustratively, the power supply 78 is configured to apply about 4 volts DC between the cathode 30 and the lead 25 to drive the decomposition of magnesium oxide in the electrolyte 40 and cover resistances and overpotentials in the elements of the circuit 75.

The anode 20 is constituted to support an oxidation reaction that is part of the overall decomposition of the oxide of the element of interest occurring electrolytically with flow of current through the electrowinning circuit 75 during operation of the system 10. Accordingly, the anode 20 may be of a material on which oxygen-bearing anions are oxidized and form gaseous oxygen, such as liquid silver, or a porous electronically-conducting oxide, for example, lanthanum strontium manganate. In another approach the anode 20 may be a metal such as liquid tin and configured with an apparatus (not shown) for bubbling a gas reactive with oxygen at the operating temperature, such as hydrogen or natural gas, through the anode 20.

The membrane 23 is capable of conducting ions between the electrolyte 40 and the anode 20 in support of the oxidation reaction at the anode 20 during electrolytic decomposition of the oxide of the element of interest in the vessel 60. The membrane 23 is illustratively of yttria-stabilized zirconia ("YSZ"), calcia-stabilized zirconia, magnesia-partially-stabilized zirconia, scandia-stabilized zirconia or some other oxygen anion conductor. The anode 20 and oxide membrane 23 together are herein referred to as the solid-oxide membrane ("SOM") anode 27. Aspects of the construction and operation of the SOM anode 27 are known to those skilled in the art and have been described, for example, in U.S. Pat. No. 5,976,345 and U.S. Patent Application Publication 2009/0000955, both incorporated herein by reference in their entireties.

Illustratively the membrane 23 in the SOM anode 27 is configured as a cylindrical tube having a closed end 28 holding the anode 20. The tube is seated through the lid 62 with an open end 29 venting to the exterior of the vessel 60 to allow the escape of gaseous products of the anodic reaction. The membrane 23 serves to shield the anode 20 from the aggressive chemical environment of the molten electrolyte 40. Accordingly, a nonconsummable material may be used for the anode 20 in the system 10, affording recycling of the element of interest with an oxygen byproduct.

The membrane 23 forming the tube may be on the order of 0.25 cm thick. The tube may be about 1 to 3 cm in diameter and on the order of 20 to 60 cm long. The length of the tube may be limited practically by the need for oxygen bubbles, which may nucleate along the entire length of the tube during current flow in the electrowinning circuit 75, to escape without excessive disruption of the liquid metal anode 20 during electrolysis in the vessel 60. It is expected that an SOM anode comprising a liquid silver anode in an yttria-stabilized zirconia tube having dimensions in these ranges may support anode currents on the order of about 1 A/cm$^2$ in a molten salt environment without degradation due to thermal stresses arising from ohmic heating or mechanical stresses due to bubble movement.

The cathode 30 is constituted to provide a surface supporting a reduction reaction producing the elemental product during operation of the circuits 95 and 75 in the system 10. Accordingly, the cathode 30 is electronically conductive and stable in the electrolyte 40. The cathode 30 may be a cylindrical rod, having an initial diameter of about 1 to 3 cm, sealed in an aperture in the lid 62, The length of the cathode 30 may be on the order of 30 to 60 cm. The lid 62 may have a convex portion 65 above the electrolyte to direct gas containing the elemental product toward a vent 66. The vent 66 may be coupled to an apparatus (not shown) for condensing, i.e., magnesium from the gas phase, as is known to those skilled in the art. To effect stirring in the electrolyte 40 near the cathode 30, a motor (not shown) outside the vessel 60 may be configured to turn the cathode 30 through a rotating mechanical seal in the lid 62, thereby rotating the cathode 30 at, e.g., about 1 to 30 revolutions per second. The cathode 30 may be equipped with a paddle 37 to enhance the efficacy of stirring by cathode rotation.

Illustratively the cathode 30 is a cylindrical conduit. A proximal end 34 of the conduit, with respect to the top surface of the electrolyte 40, is coupled to a source (not shown) of an inert gas such as argon. A distal end 35 of the conduit is submerged in the electrolyte 40. The cathode 30 is thus arranged to dispense bubbles 39 which dilute the elemental product, stir the region of the electrolyte 40 near the cathode 30, and convey the elemental product out of the electrolyte 40. The cathode 30 may be constructed so that the bubbles emerge from the paddle 37. In an alternative embodiment, the diluent gas may be forced through the electrolyte 40, for example by bottom-blowing tuyeres (not shown) fixed in the bottom of the vessel 60 under the cathode 30. The flow rate of the inert gas is illustratively sufficient to dilute the elemental product to prevent its adverse reaction with the membrane 23 without complicating later recovery, outside the vessel 60, of the elemental product in a liquid state. Techniques for managing transport of a gas through a liquid such as a molten salt are known to those skilled in the art.

The ionically conductive liquid electrolyte 40 is constituted to solvate species bearing the element of interest in an oxidized state and to dissolve the oxide of the element of interest introduced into the body 50 with the feedstock material or otherwise added to the electrolyte 40. In the present example the oxide of the element of interest is magnesium oxide. The electrolyte 40 also may be formulated for other properties supporting optimal function of the system 10 such as low vapor pressure; low electronic conductivity and sufficient ion mobility for adequate diffusivities and conductivities; low viscosity, e.g., less than about 1 poise; and relatively high density. Ideally the electrolyte 40 is chemically compatible with other constituents of the system 10 such as the membrane 23, vessel 60, and a barrier 52 (described below) and does not contain reducible species bearing elements more electronegative than the element of interest.

Illustratively the electrolyte 40 includes one or more metal halides, optionally combined with additives to tailor properties as stated above. The metal halide content may be at least about 25%, 45%, 60%, 80%, 90% or more of the electrolyte 40 by weight. In one embodiment, the metal halides include two or more metal fluorides. For example, the electrolyte 40 may be magnesium fluoride with an additional fluoride selected to promote stability of the membrane 23, illustratively calcium fluoride or yttrium fluoride as appropriate to the membrane composition. For example, an electrolyte 40 used with a membrane 23 of YSZ may comprise about 1% to 10% yttrium fluoride. A 50-50 mixture of $MgF_2$ and $CaF_2$ is fluid with a vapor pressure of about $3\times10^{-6}$ atm at 1100° C. and $9\times10^{-5}$ atm at 1300° C. Magnesium fluoride itself melts at 1252° C. and may be usable as an electrolyte in the system 10 at, e.g., around 1300° C.

The liquid body 50 that is the scrap electrode incorporates the element of interest in its molten state, not bonded to form a compound. The liquid body 50 may be a liquid alloy. Upon addition to the liquid body 50 of feedstock material, alloyed elements contained therein melt and augment the body 50 while insoluble feedstock constituents such as oxide particles are rejected, e.g., to the interface 58. In general, the composition of the liquid body 50 varies during operation of the system 10 as sequential additions of feedstock material to be processed, which may not be of consistent elemental make-up, become part of the scrap electrode 50 and the element of interest is removed therefrom across the interface by operation of the electrorefining circuit 95. In the present example, the feedstock material may be a magnesium material at least partly oxidized, for example post-consumer scrap or oxidized dry machining chips. Illustratively the magnesium material includes an alloy incorporating, e.g., calcium or aluminum. The current collector 55 may be of a noble metal, compatible with the liquid body 50, such as iridium.

In the embodiment, the liquid body 50 is constituted to have a density lower than the density of magnesium oxide ($\rho$=3.6 g/cm$^3$) and lower than the density of the electrolyte 40 so that it floats on an upper surface of the electrolyte 40 to form the interface 58. Given the very low density of liquid magnesium ($\rho\approx$1.6 g/cm$^3$), the floating arrangement can be maintained over a wide range of compositions of the scrap electrode 50, so that the system 10 is versatile with respect to the feedstock materials serviced.

To tailor the physical properties of the liquid body 50 for optimum operation of the system 10, the scrap electrode 50 may contain matter and elements other than those contained in the feedstock material melted in the scrap electrode. For example, the composition of the liquid body 50 may be chosen to limit the vapor pressure of magnesium over the liquid body 50 to a manageable value. Illustratively, aluminum is added so that the aluminum content of the liquid body 50 constitutes, e.g., at least 50%, 70% or 90% of the weight thereof. Beryllium and silicon are other candidates for constituents of the liquid body 50 for purposes of limiting magnesium vapor pressure.

The body 50 is kept from direct contact with the membrane 23 and the cathode 30 by the barrier 52. The barrier 52 is arranged also to confine volatile species in the liquid body 50 to the headroom in the vessel 60 over the liquid body 50 and prevent such species from mixing with a vapor phase that is carrying the elemental product in space over the electrolyte 40 on the way to the vent 66. Thus, such species may be kept from being incorporated into the gas phase bearing the product out the vent 66. The final elemental product is thus kept free from any undesirable volatile elements, e.g., zinc, present in the feedstock material. The barrier 52 is furthermore configured to bound an interface 58 presenting an appropriate anodic surface area during operation of the system 10. The portion of the lid 62 over the body 50 may be equipped with two sequential sealable apertures arranged in an airlock configuration (not shown), known to those skilled in the art, to allow repeated addition of increments of feedstock material to the body 50 with minimal loss of heat and matter from the body 50. The lid 62 may furthermore be similarly apertured to allow addition of the oxide of the element of interest directly to the electrolyte 40 outside of the area within the barrier 52.

Operating temperatures of respective elements of the system 10 are chosen in view of the properties and function of the anode 20, membrane 23, cathode, 30 and electrolyte 40 and the desired respective states of the elemental product to be formed and the liquid body 50. Considerations of electrical conductivity in constituents of the system 10 generally favor operation at relatively high temperatures within the possible range. On the other hand, volatile elements in some electrolyte formulations may make the electrolyte 40 more difficult to contain at higher operating temperatures. A temperature range of about 1100° C. to 1300° C. throughout the electrolyte 40 may provide a suitable baseline for magnesium recycling and/or extraction in the system 10. Joule heating during operation is supportive of such high operating temperatures.

To operate the system 10 to produce the element of interest in a gaseous state, the cathode 30 is maintained at an operating temperature greater than the dewpoint of the elemental product in the bubbles 39, which is a function of the cathodic current and argon flow rate. Illustratively, in the case of magnesium, the cathode 30 is maintained at an operating temperature greater than about 850° C. and less than about 1500° C. The scrap electrode 50 is maintained at a temperature at which the vapor pressure over the liquid body 50 is desirably low. The operating temperature scrap electrode 50 is selected with consideration of its composition but is generally lower than the temperature at the cathode 30. Illustratively, the operating temperature of the scrap electrode 50 is less than about the boiling point of magnesium, 1091° C.

Figure 2:
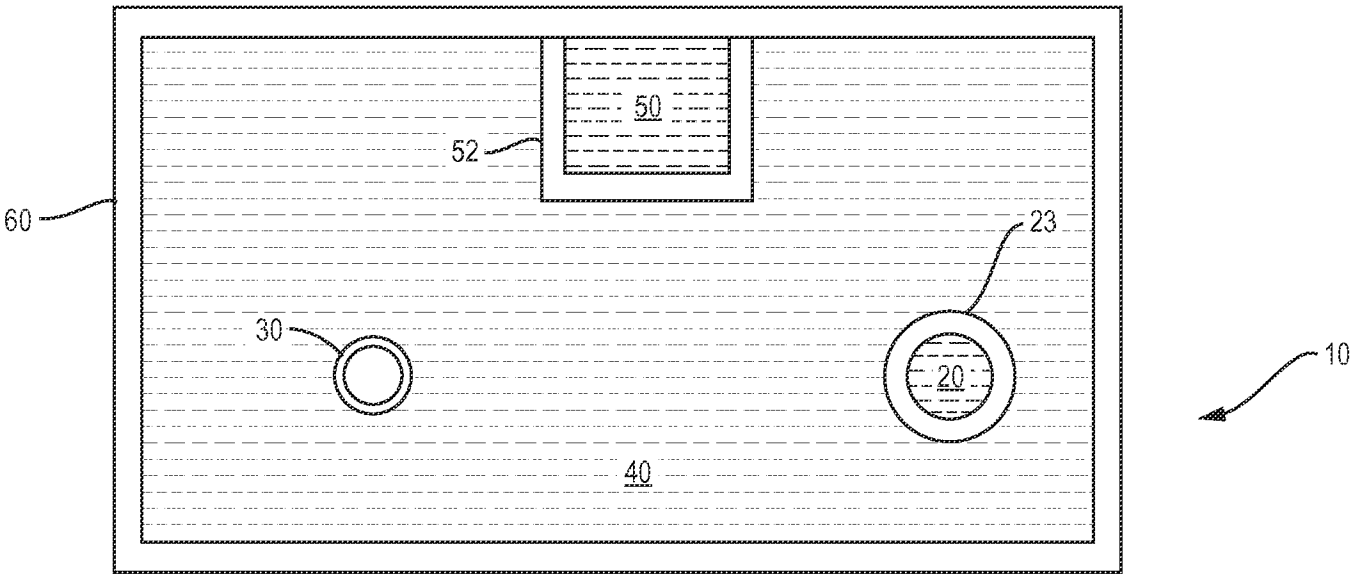
FIG. 2 is a sectional view of the cathode, liquid pool, and anode shown in FIG. 1, taken parallel to the lid of the floating-electrode recycling system.

A higher temperature at the cathode 30 than at the scrap electrode 50 may be promoted by three features of the system 10. The first feature is a greater current density at the cathode 30 than at the scrap anode 50 due to a smaller surface area on the cathode 30 compared to the interface 58. Illustratively, the area of the interface 58 is on the order of at least 10, 20, 25 or more times the surface area of the cathode 30. Second, adding the feedstock material to the scrap anode 50 in solid form depresses the local temperature due to absorption of heat by the feedstock material upon melting. Finally, with reference to FIG. 2, configuring the system 10 with the liquid body 50 against the side of the vessel 60 enhances heat loss preferentially from the scrap electrode 50. These features afford the system 10 the ability to implement an electrochemical process to obtain a gaseous elemental product, recoverable to a condensed phase, from a liquid source. Thus the system 10 is operable as an electrorefining apparatus, appropriate for processing feedstock materials containing minimal magnesium oxide. Accordingly, in an alternative embodiment, the system 10 may be configured without the electrowinning circuit 75 by omitting the SOM 27 and the power supply 78.

The vessel 60 and lid 62 are constituted to form an enclosure tight against intrusion by exterior ambient gas. The system 10 may include apparatus (not shown) for backfilling the headroom above the electrolyte 40 with an inert gas such as argon or nitrogen. Techniques and materials ancillary to confining molten salts and their vapors at elevated temperatures in a container such as the vessel 60 with an apertured cover such as the lid 62 and techniques for achieving and maintaining operating temperatures of molten constituents such as the electrolyte 40 and the liquid body 50 are known to those skilled in the art.

The vessel 60 and barrier 52 are of materials compatible with the chemistry of the electrolyte 40, so that interactions with the electrolyte 40 cause minimal degradation of the integrity of the vessel 60 or barrier 52 or contamination of the electrolyte 40. The vessel 60 and barrier 52 may be of electrically conductive materials. For use with an electrolyte 40 of halide salts and oxides, a stainless or, preferably, mild carbon steel may be serviceable. Illustratively the barrier 52 is made of an electronically conductive material and functions simultaneously as the current collector 55 in the electrorefining circuit 95.

In alternative embodiments, the system 10 may be equipped with one or more appliances (not shown) to agitate the liquid electrolyte 40 in order to promote compositional uniformity in the liquid and reduce diffusion effects in the vessel 60 during operation. Gas bubbles may be forced through the electrolyte 40, for example by bottom-blowing tuyeres aligned with any or all of the anode 20, cathode 30, and liquid body 50. Exterior magnets may be situated to apply a vertically oriented DC magnetic field, which interacts with currents through the electrolyte 40 to induce a magnetohydrodynamic stirring force therein. Methods for agitating liquids such as the electrolyte 40 in a gas-tight enclosure such as the vessel 60 are known to those skilled in the art.

In an exemplary process method for recycling magnesium, the system 10 shown in FIG. 1 is configured with a cylindrical conduit of steel, about 3 cm in outer diameter, as the cathode 30. An YSZ tube, 3 cm in outer diameter, holding liquid silver serves as the SOM anode 27. The anode lead 25 is illustratively a wire of a noble metal such as iridium. The length of each of the cathode 30 and the SOM anode 48 in contact with the electrolyte 40 is about 30 cm long. About 90% of the electrolyte 40 by weight is a 50-50 mixture of $MgF_2$—$CaF_2$, doped with about 2% yttrium fluoride. The average interior temperature of the electrolyte 40 in the vessel 60 is about 1100-1300° C.

Solid feedstock material including a metallic magnesium alloy and magnesium oxide is placed in the vessel 60 within the barrier 52 and melted in the scrap electrode 50. The temperature of the scrap electrode 50 is maintained at about 1100° C. The magnesium oxide remains solid at this temperature and sinks to the interface 58, where it dissolves in the electrolyte 40.

The cathode 30 is rotated around its axis at about 10 revolutions per second while argon is forced through the cathode 30 to emerge from the distal end 35. Stirring the electrolyte 40 reduces concentration differences in the electrolyte 40 near the cathode 30 and other regions of the electrolyte 40 and promotes formation of elemental magnesium at the cathode 30 at a higher rate.

The power supply 68 of the electrorefining circuit 95 is operated, thereby inducing oxidation of magnesium in the liquid body 50 at the interface 58 between the liquid body 50, which functions as an anode in the circuit 95, and the electrolyte 40, For alloys in the feedstock material having no element less electronegative than magnesium, it is the first, and likely only, element oxidized in the scrap electrode 50. Any constituent elements less electronegative than magnesium may be oxidized by the operation of the electrorefining circuit 95 and cross the interface 58 into the electrolyte 40. Such low-electronegativity elements, such as calcium and strontium, may not be reduced in the electrorefining circuit but instead accumulate in the electrolyte 40.

Species bearing magnesium in the oxidized state enter the electrolyte 40 and migrate toward the cathode 30. At the cathode, the oxidized magnesium species is reduced to produce neutral, elemental magnesium which is carried to the top surface of the electrolyte in the bubbles 39 and out the vent 66 to be recovered. The system 10 may refine magnesium from the scrap anode 50 with consumption of about 2-3 kWh per kilogram of magnesium separated from the scrap anode 50. The current density at the cathode 30 may be greater than 5, 10, 15, 25 $A/cm^2$ or more and on the order of 10, 20, 25 times or more the current density across the interface 58.

Simultaneously the power supply 78 of the electrowinning circuit 75 is operated at a constant potential of 4 V, thereby inducing decomposition of the magnesium oxide in the electrolyte 40 with oxidation of oxygen species and reduction of magnesium species. Oxygen anions diffuse through the membrane 23 to the anode 20, where gaseous oxygen is formed, releasing electrons that pass to the power supply 78. The gaseous oxygen exits the vessel 60 through the open end 29 of the tube. At the same time, electrons are delivered through the cathode 30 to its interface with the electrolyte 40. Magnesium-bearing species in the electrolyte 40 are reduced at the cathode 30 to produce elemental magnesium which is removed from the vessel 60 through the vent 66 as described above. The system 10 may extract magnesium from magnesium oxide with consumption of about 8.8 kWh per kilogram of magnesium extracted. When oxide ions have been depleted from the electrolyte 40, the current and power consumption in the electrowinning circuit falls to zero.

The circuits 95 and 75 are ideally operated to produce magnesium at a rate consistent with a desirable balance of magnesium vapor and argon in the bubbles 39 as described above. In the operating temperature range of the system 10, the intersection of the magnesium/magnesium oxide and zirconium/zirconium oxide equilibria occurs at about 0.14 atm of magnesium vapor, with higher magnesium vapor pressure consuming zirconium oxide with damage to the membrane 23. Accordingly, the volume ratio in the bubbles 39 of argon to elemental magnesium gas in the exemplary process sequence may be fixed so that the magnesium vapor pressure is somewhat, but not very much lower than 0.14. Illustratively, the Ar:Mg ratio in the gas phase may be about 10:1.

Illustratively repeated additions of feedstock material are made to replenish the scrap electrode 50 as its magnesium content is diminished by transport across the interface 58 during operation of the electrorefining circuit 95. If the additions include sufficient magnesium oxide to raise the MgO-content of the electrolyte 40 above some threshold level, the electrowinning circuit will again draw current and extract magnesium and oxygen from the electrolyte 40. Power consumption in the system 10 therefore adjusts automatically to the rate needed to recycle a given feedstock material and degree of magnesium oxidation.

The illustrative continuous process results in a very pure magnesium product while being flexible with respect to the composition of the feedstock material, so that the system 10 is adaptable to recycle magnesium alloys of diverse types and degrees of oxidation including fully oxidized magnesium.

Alternatively or additionally, supplementary magnesium oxide, independent of feedstock material to be recycled, may be introduced into the scrap electrode 50 or directly into the electrolyte 40. Magnesium may then be extracted from this supplementary MgO through operation of the electrowinning circuit 75. Thus the illustrative cell 10 may function to produce magnesium by recycling and/or electrowinning, simultaneously or by turns, affording versatile operation adaptable to the available magnesium source material.

Figure 3:
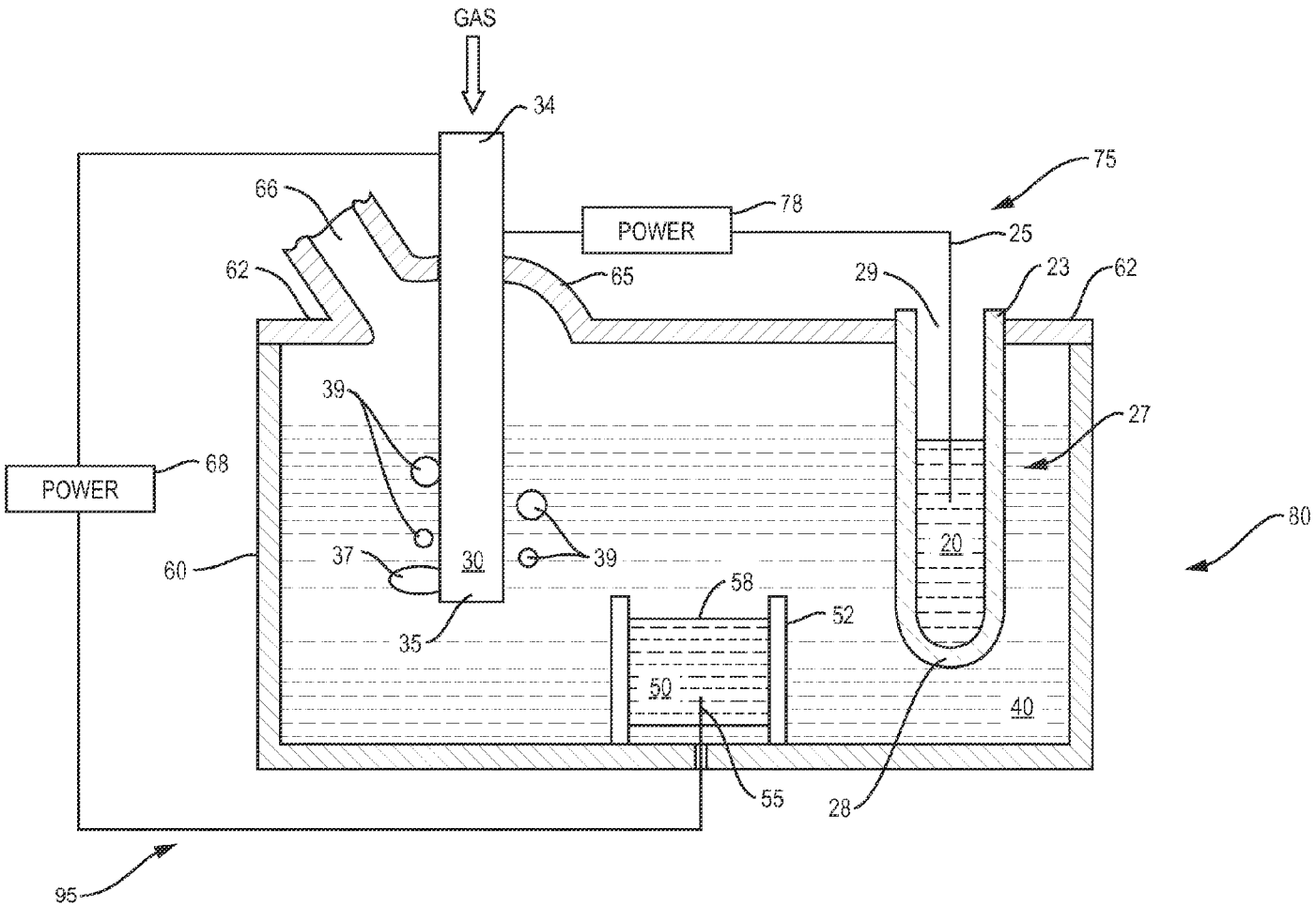
FIG. 3 is a schematic diagram of a submerged-electrode recycling system compatible with the invention in which the vessel, scrap electrode and anode are shown in cross section.

With reference to FIG. 3, in another embodiment an electrolytic recycling system 80 is configured with the electrolyte 40 floating on an upper surface of the scrap electrode 50 at the interface 58 between the electrolyte 40 and the scrap electrode 50. The compositions of the liquid body 50 and the electrolyte 40 are chosen conjunctionally to tailor their respective densities to support this arrangement of components. Accordingly an element of relatively high density and electronegativity, e.g., tin, may be melted in the scrap electrode 50 in addition to magnesium and other elements introduced with the feedstock material. The lid 62 may be configured to open above the electrolyte 40 over the scrap electrode 50, as described above with reference to the system 10, to permit addition of feedstock material during operation of the system 10. During operation, the electrorefining and electrowinning circuits 95 and 75 and the system 80 in general function as described above with reference to the floating-electrode recycling system 10. Relatively dense solid feedstock material to be recycled or supplementary magnesium oxide may be added to the scrap electrode 50 by placement in the vessel 60 at the electrolyte 40 over the liquid body 50. The added solid material sinks through the electrolyte 40 and crosses the interface 58 into the liquid body 50. Magnesium oxide in the feedstock material may dissolve in the electrolyte 40 before reaching, or after being stopped at, the interface 58.

Figure 4:
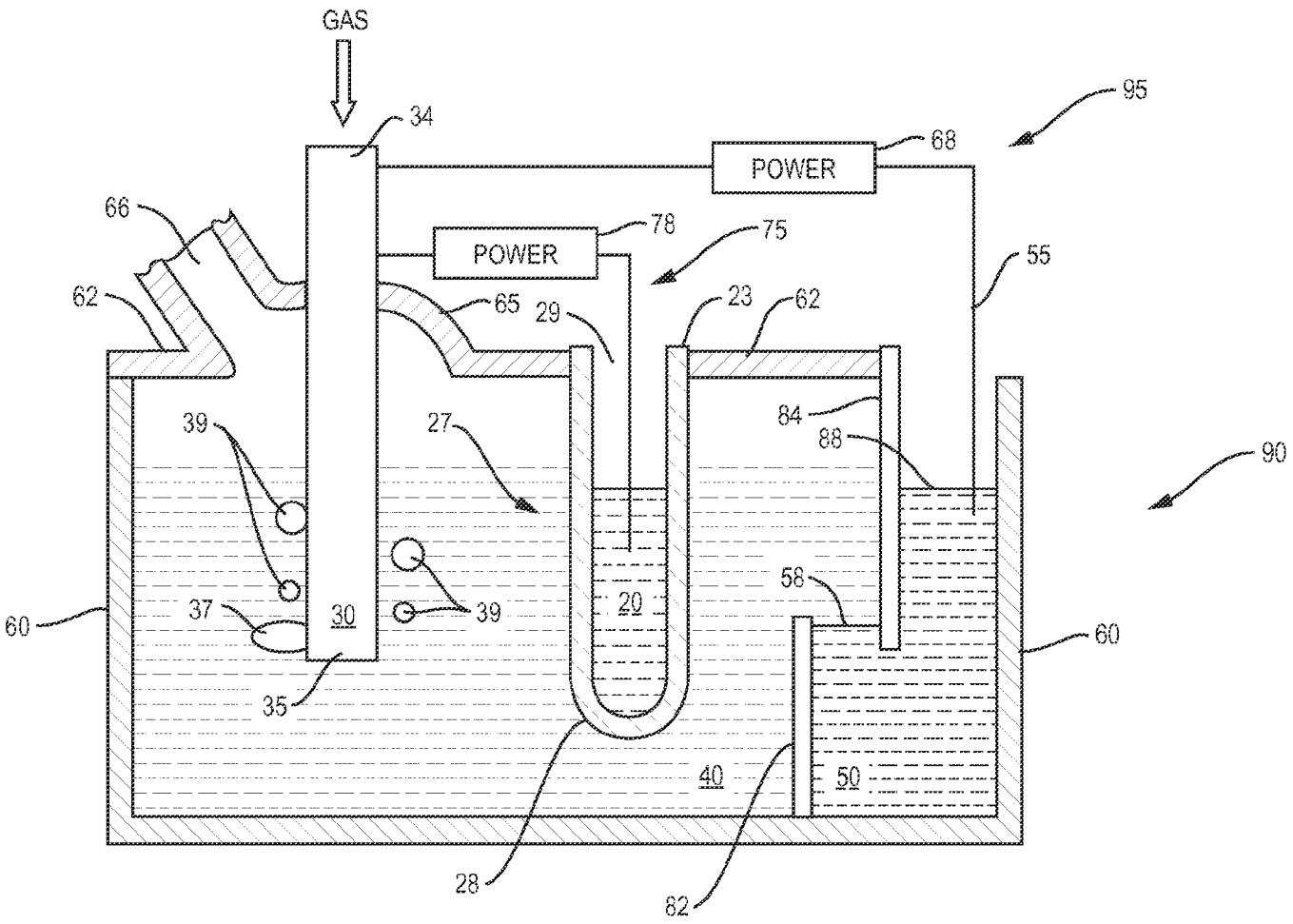
FIG. 4 is a schematic diagram of an exterior-feedable recycling system compatible with the invention in which the vessel, scrap electrode and anode are shown in cross section.

With reference to FIG. 4, in yet another embodiment an electrolytic recycling system 90 is configured with the liquid body 50 having a relatively high density compared to the electrolyte 40 as described above for the system 80. The liquid body 50 is disposed under the electrolyte 40, illustratively held between a side of the vessel 60 and a barrier in the form of a lower portion 82 and an upper portion 84. The lower portion 82 and the upper portion 84 may be parallel and spaced apart from one another. The interface 58 separates the electrolyte 40 and the liquid body 50 between the lower and upper portions 82 and 84. During operation the system 90 functions as described above with reference to the submerged-electrode system 80. A free surface 88 of the liquid body 50 is accessible from the exterior of the vessel 60 for receiving increments of feedstock material during operation of the system 90. The lid 62 may be configured with an opening over the electrolyte 40 as described above with reference to an opening over the scrap electrode 50 in the system 10, to permit addition of supplementary magnesium oxide during operation of the system 10.

The systems 10, 80 and 90 and their associated methods of use are adaptable for recycling or refining relatively low-melting elements other than magnesium. Feedstock materials incorporating elements that melt to form electronically conductive liquids—for example any of zinc, cadmium, lead, gallium, bismuth, and tin—may be refined or recycled by the illustrative apparatus and methods by selection of operating parameters and materials for cell components, such as the scrap anode 50 and vessel 60, according to the considerations presented above with reference to magnesium recycling.

Although specific features of the invention are included in some embodiments and not in others, it should be noted that an individual feature may be combinable with any or all of the other features in accordance with the invention. Furthermore, other configurations are compatible with the described features. It will therefore be seen that the foregoing represents a highly advantageous approach to recycling an element from an alloy or oxidized feedstock, particularly as a gaseous product. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of producing magnesium from a feedstock material including magnesium oxide and magnesium not bonded in the magnesium oxide, comprising:

providing a liquid electrolyte capable of dissolving magnesium oxide;

providing a cathode in electrical contact with the electrolyte;

providing an anode, separated from the electrolyte by a membrane capable of conducting oxygen anions;

melting the feedstock material, the melted feedstock material being in an electronically conductive liquid, in contact with the electrolyte along a horizontal interface and not in contact with either of the cathode and the membrane;

extracting electrons from the electronically conductive liquid, thereby generating species bearing magnesium in an oxidized state in the electrolyte; and providing electrons to the cathode, thereby forming elemental magnesium thereat.

2. The method of claim 1 wherein the cathode is at a temperature greater than 850° C. and the elemental magnesium formed at the cathode is in a gaseous phase.

3. The method of claim 2 further comprising conveying the elemental magnesium out of the electrolyte by flow of an inert gas.

4. The method of claim 1 wherein the electronically conductive liquid includes matter other than the melted feedstock material.

5. The method of claim 4 wherein the matter includes aluminum.

6. The method of claim 4 wherein the matter includes tin.

7. The method of claim 4 wherein a metal other than magnesium constitutes at least 50% of the electronically conductive liquid by weight.

8. The method of claim 4 wherein a metal other than magnesium constitutes at least 80% of the electronically conductive liquid by weight.

9. The method of claim 1 wherein a barrier prevents direct contact between the electronically conductive liquid and the cathode and membrane.

10. The method of claim 1 further comprising extracting electrons from the anode.

11. The method of claim 4 wherein magnesium oxide in the feedstock material passes from the electronically conductive liquid into the electrolyte.

12. The method of claim 4 further comprising adding magnesium oxide to the electrolyte.

13. The method of claim 4 wherein electrons are extracted from the anode and the electronically conductive liquid simultaneously.

14. The method of claim 1 further comprising repeatedly adding feedstock material to the electronically conductive liquid.

15. The method of claim 1 wherein the feedstock material includes oxidized machining chips.

16. The method of claim 1 wherein the feedstock material includes a magnesium-calcium alloy.

17. The method of claim 1 wherein the feedstock material includes a magnesium-aluminum alloy.

18. The method of claim 1 wherein the feedstock material includes post-consumer magnesium scrap.

19. The method of claim 1 wherein a current density at the cathode during formation of elemental magnesium thereat is at least ten times a second current density across the interface.

20. The method of claim 1 wherein a current density at the cathode during formation of elemental magnesium thereat is at least 25 A/cm.sup.2.

21. The method of claim 1 wherein the feedstock material includes a metal other than magnesium.

22. The method of claim 1 wherein the electronically conductive liquid has a density and the electrolyte has a density less than the density of the electronically conductive liquid.

23. The method of claim 1 wherein the electronically conductive liquid floats on the electrolyte.

24. The method of claim 1 wherein the electrolyte incorporates fluorides.

25. The method of claim 1 wherein magnesium fluoride constitutes at least 25% of the electrolyte by weight.

26. The method of claim 25 wherein the membrane incorporates zirconium oxide partially stabilized by magnesium oxide.

27. The method of claim 25 wherein the membrane incorporates zirconium oxide at least partially stabilized by at least one of scandium oxide, yttrium oxide and calcium oxide.

28. The method of claim 1 wherein the electronically conductive liquid is at a temperature of 850° C. to 1500° C.

29. The method of claim 1 wherein the cathode is at a temperature less than about 1100° C.

30. An apparatus for producing magnesium from a feedstock material including magnesium oxide and magnesium not bonded in the magnesium oxide, comprising:

a liquid electrolyte, capable of dissolving magnesium oxide;

a cathode in electrical contact with the liquid electrolyte;

an anode separated from the liquid electrolyte by a membrane capable of conducting oxygen anions from the electrolyte;

an electronically conductive liquid incorporating magnesium, not bonded to oxygen, from melted feedstock material, in contact with the electrolyte at a horizontal interface and not in contact with either of the cathode and the membrane;

and a current collector in electrical contact with the electronically conductive liquid.

31. The apparatus of claim 30 further comprising a power source configured to provide electrons to the cathode and extract electrons from the current collector.

32. The apparatus of claim 30 wherein the power source is further configured to apply a voltage across the anode and the cathode.

33. The apparatus of claim 31 wherein the power source is configured to apply a voltage across the current collector and the cathode.

34. The apparatus of claim 30 further comprising a vertical barrier preventing direct contact between the electronically conductive liquid and the cathode.

35. The apparatus of claim 30 further comprising a housing containing the electrolyte and having a sealable aperture allowing repeated addition of feedstock material to the electronically conductive liquid.

36. The apparatus of claim 30 wherein magnesium fluoride constitutes at least 25% of the electrolyte.

37. The apparatus of claim 30 wherein the cathode is at a temperature of 850° C. to 1500° C.

38. The apparatus of claim 31 wherein the apparatus is operable to form elemental magnesium at the cathode.

39. The apparatus of claim 31 wherein the electrolyte has a top surface and the cathode is a tube having an end distal to the top surface and further comprising a source of inert gas coupled to the tube so as to introduce the inert gas into the electrolyte from the distal end of the tube.

40. The apparatus of claim 30 wherein the electronically conductive liquid incorporates post-consumer magnesium scrap melted in the apparatus.

41. The apparatus of claim 30 wherein the electronically conductive liquid has a density and the electrolyte has a density less than the density of the electronically conductive liquid.

42. The apparatus of claim 30 wherein the electronically conductive liquid floats on the electrolyte.

43. The apparatus of claim 30 wherein the electronically conductive liquid includes aluminum.

44. The apparatus of claim 30 wherein the cathode has a surface area in contact with the electrolyte and the ratio of the area of the interface to the surface area is at least about 10.

45. The apparatus of claim 38 further comprising a barrier separating a vapor phase over the electronically conductive liquid from mixing over the electrolyte with a vapor phase carrying elemental magnesium formed at the cathode.

46. An apparatus for producing an element from a feedstock material including an oxide of the element and the element not bonded in the oxide, comprising:

a liquid electrolyte, capable of dissolving the oxide;

a cathode in electrical contact with the liquid electrolyte;

an anode separated from the liquid electrolyte by a membrane capable of conducting oxygen anions from the electrolyte;

an electronically conductive liquid incorporating the element, not bonded to oxygen, from melted feedstock material, in contact with the electrolyte at a horizontal interface and not in contact with either of the cathode and the membrane; and a current collector in electrical contact with the electronically conductive liquid.

47. The apparatus of claim 30 wherein the current collector is an electronically conductive barrier preventing direct contact between the electronically conductive liquid and the cathode.

* * * * *